US011684081B2

(12) United States Patent
Sanchéz Vila

(10) Patent No.: US 11,684,081 B2
(45) Date of Patent: Jun. 27, 2023

(54) GUM FOR CIGARETTE PAPER, CIGARETTE PAPER AND PROCESS FOR MAKING IT

(71) Applicant: Republic Technologies (North America) LLC, Glenview, IL (US)

(72) Inventor: Santiago Sanchéz Vila, Barcelona (ES)

(73) Assignee: REPUBLIC TECHNOLOGIES (NORTH AMERICA) LLC, Glenview, IL (US)

( * ) Notice: Subject to any disclaimer, the term of this patent is extended or adjusted under 35 U.S.C. 154(b) by 162 days.

(21) Appl. No.: 17/125,281

(22) Filed: Dec. 17, 2020

(65) Prior Publication Data

US 2022/0132912 A1 May 5, 2022

(30) Foreign Application Priority Data

Oct. 29, 2020 (FR) ..... 2011098

(51) Int. Cl.

| | |
|---|---|
| ***A24D 1/02*** | (2006.01) |
| ***A24D 1/18*** | (2006.01) |
| ***A24B 15/20*** | (2006.01) |
| ***A24B 15/30*** | (2006.01) |
| ***A24B 15/40*** | (2006.01) |

(52) U.S. Cl.

CPC ..... *A24D 1/022* (2013.01); *A24B 15/303* (2013.01); *A24B 15/403* (2013.01); *A24D 1/18* (2013.01)

(58) Field of Classification Search

None

See application file for complete search history.

(56) References Cited

U.S. PATENT DOCUMENTS

| | | | | |
|---|---|---|---|---|
| 2018/0360103 | A1 | 12/2018 | Kaplan et al. | |
| 2019/0390408 | A1 | 12/2019 | Luxenbourg et al. | |
| 2020/0035121 | A1* | 1/2020 | Pandolfino | A24D 1/18 |
| 2020/0128872 | A1 | 4/2020 | Hunter et al. | |
| 2020/0253267 | A1* | 8/2020 | Rousseau | A61K 31/05 |
| 2020/0253268 | A1* | 8/2020 | Rousseau | A61K 31/352 |

FOREIGN PATENT DOCUMENTS

| | | | |
|---|---|---|---|
| CN | 111840130 A | * | 10/2020 |
| WO | WO 2017/196840 A1 | | 11/2017 |

OTHER PUBLICATIONS

Machine translation of CN111840130A, European Patent office, [online], retrieved from the Internet, [retrieved Jan. 30, 2023],<URL: https://worldwide.espacenet.com/patent/search/family/072968654/publication/CN111840130A?q=CN111840130>. (Year: 2023).*

Search Report as issued in French Patent Application No. 2011098, dated Jul. 6, 2021.

* cited by examiner

*Primary Examiner* — Dennis R Cordray

(74) *Attorney, Agent, or Firm* — Pillsbury Winthrop Shaw Pittman LLP

(57) ABSTRACT

A gum of vegetable origin for rolling cigarette paper including a solids content, includes a mixture of cannabinoids and edible oil, the edible oil being present in the mixture in a proportion p such that 0%≤p≤80% by weight of the compound. Since cannabinoids are soluble only in oil and the gum is intended to be brought to the mouth because it should be reactivatable by licking once coated, smoked and swallowed, oil is edible.

7 Claims, 9 Drawing Sheets

[Fig. 1]
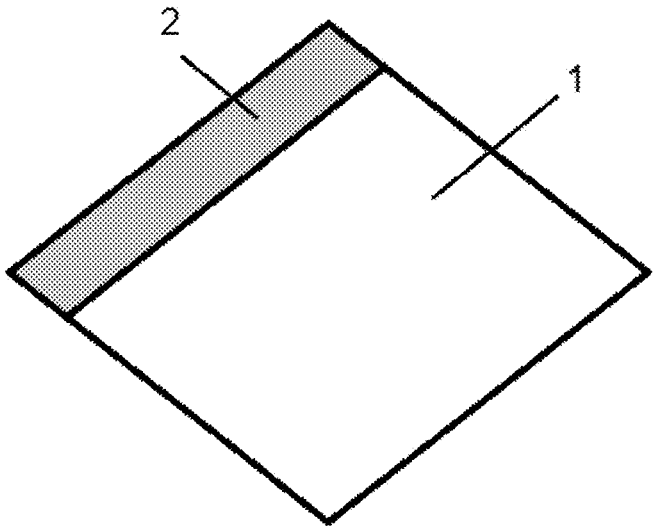
[Fig. 2]
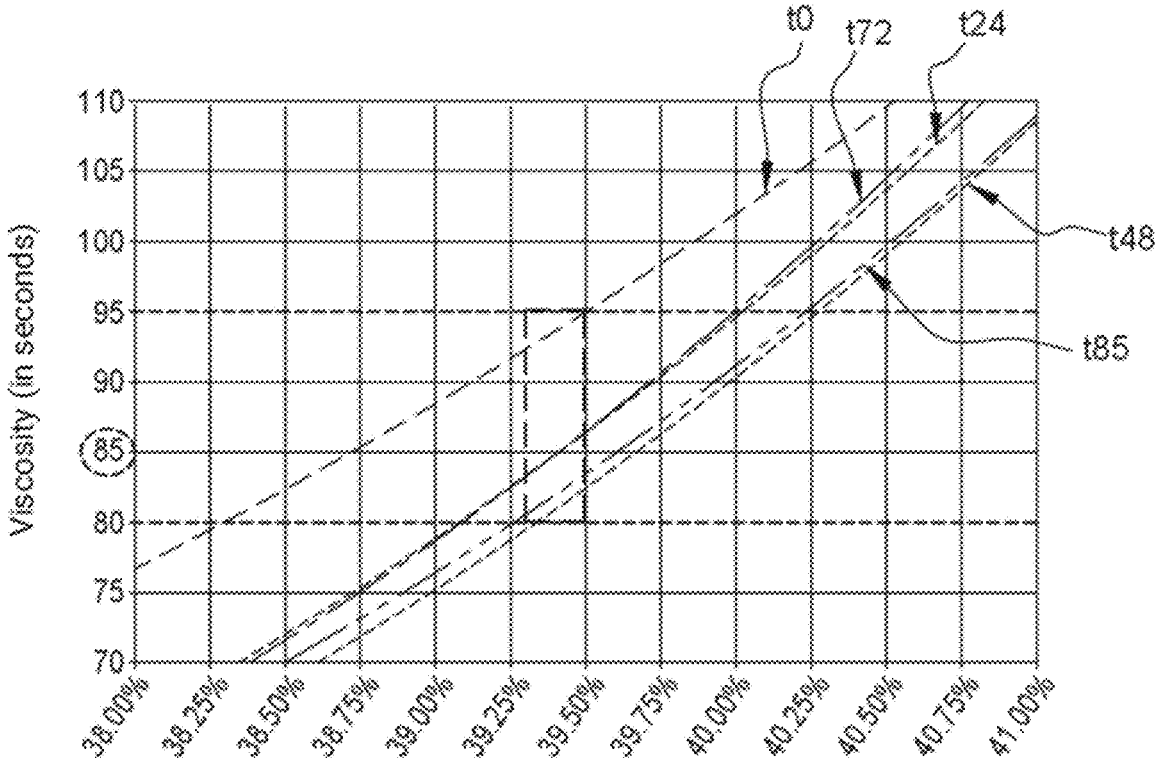

[Fig. 3]
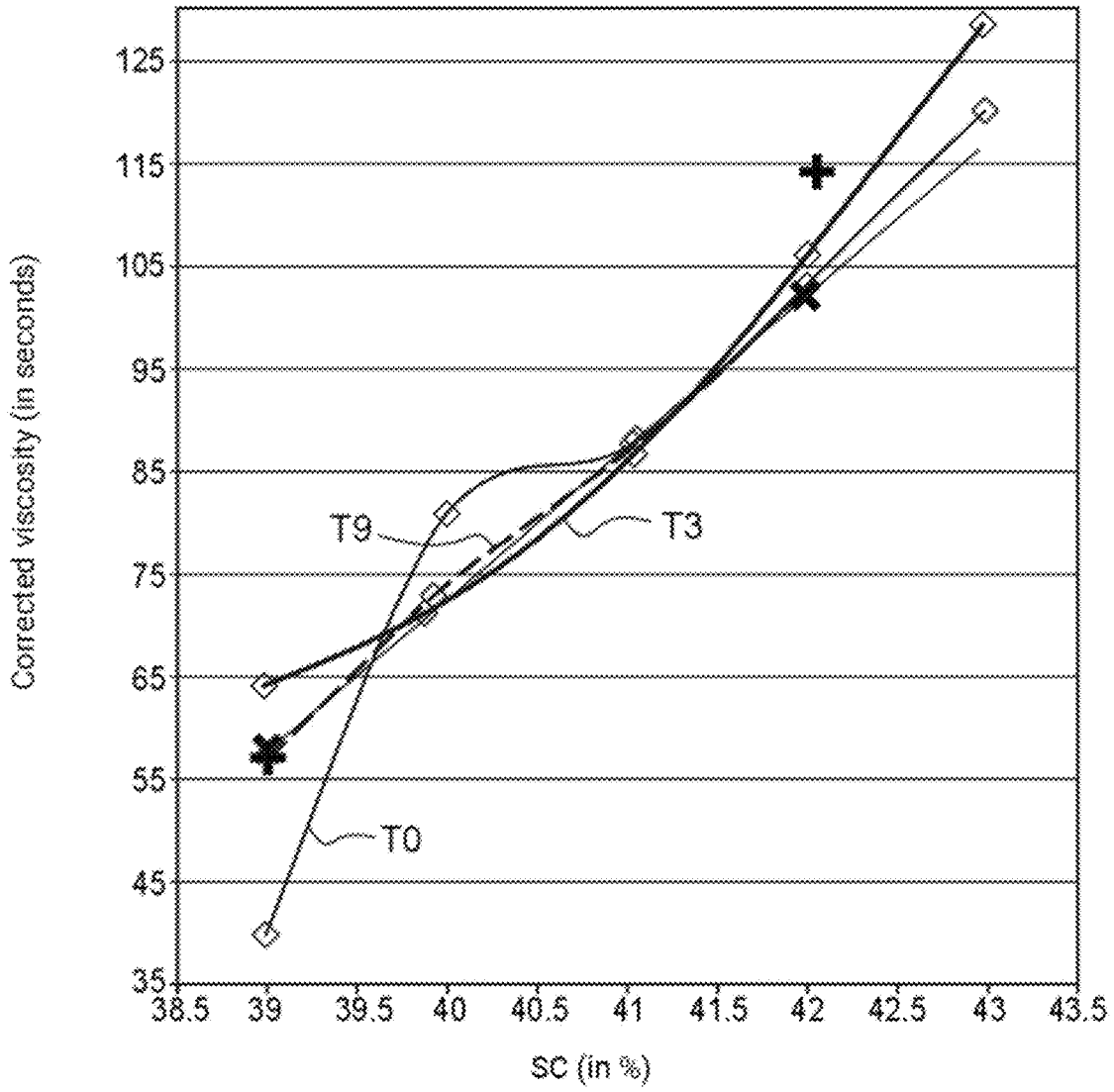
[Fig. 4]
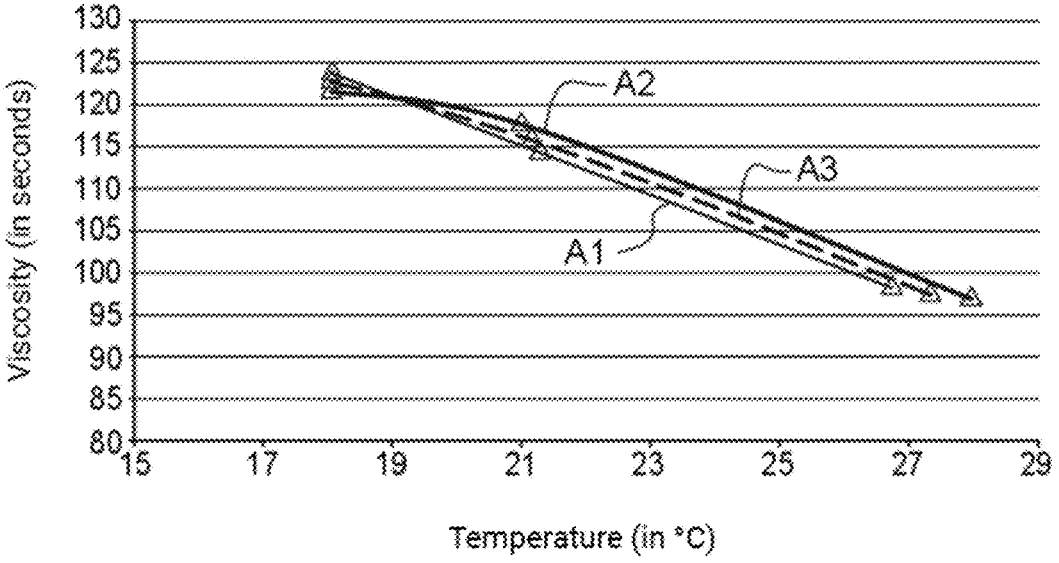

[Fig. 5]
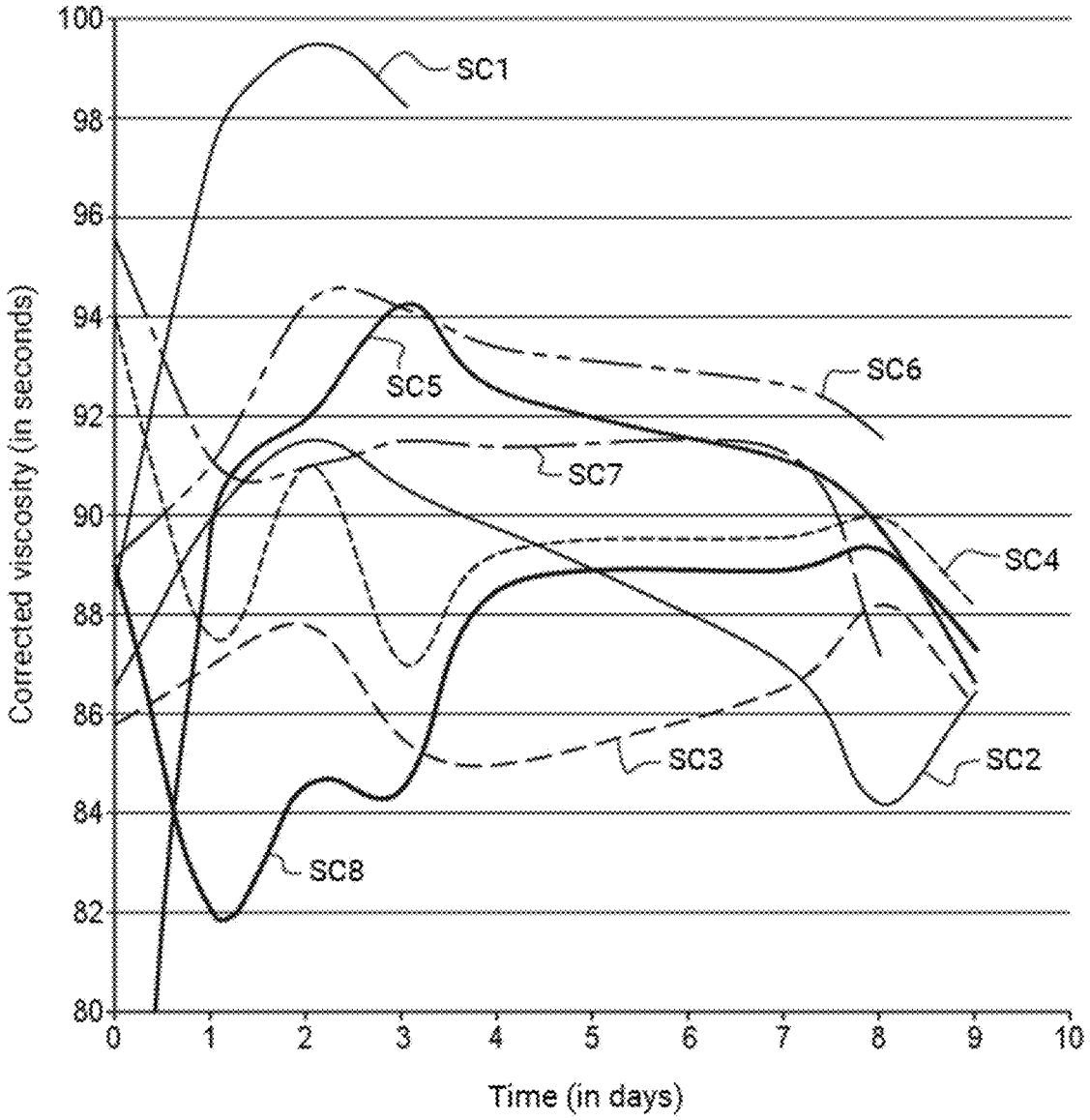

[Fig. 6]
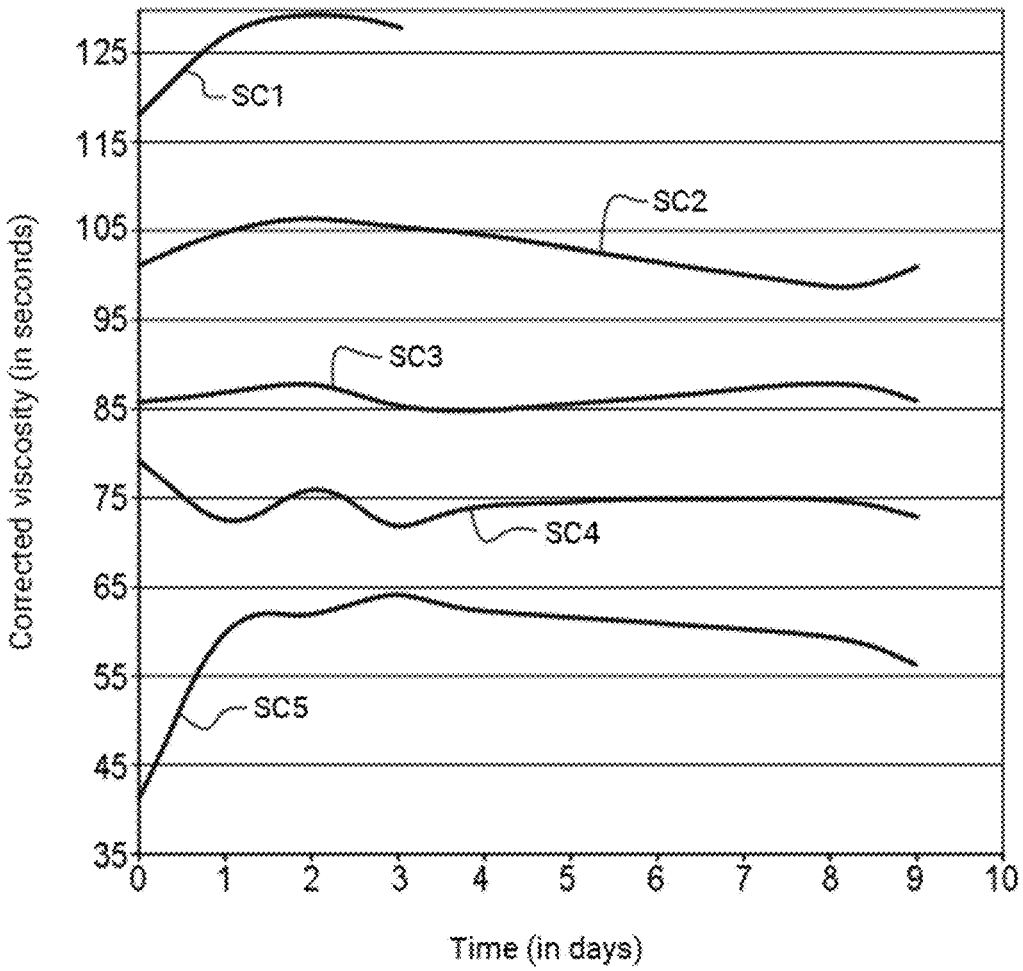
[Fig. 7]
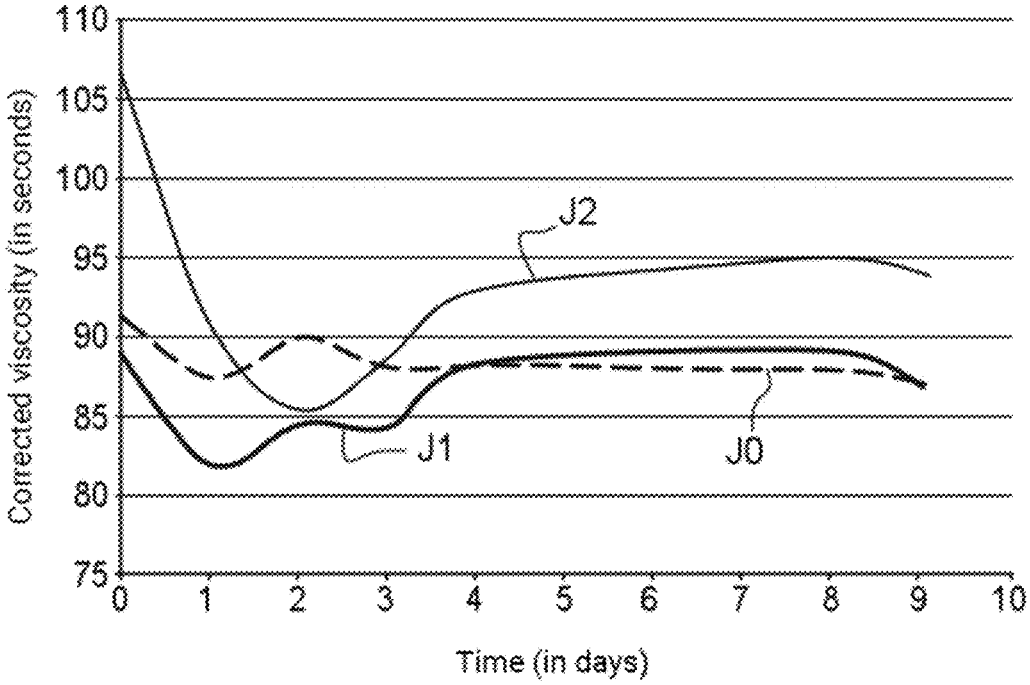

[Fig. 8]
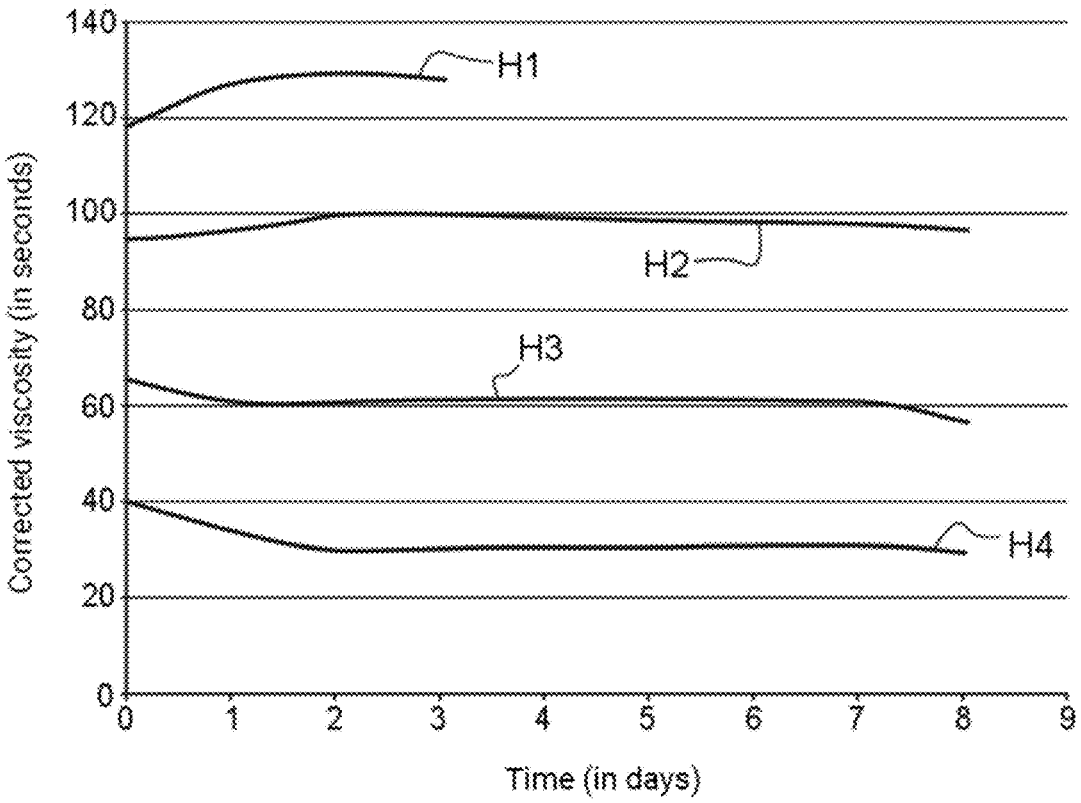
[Fig. 9]
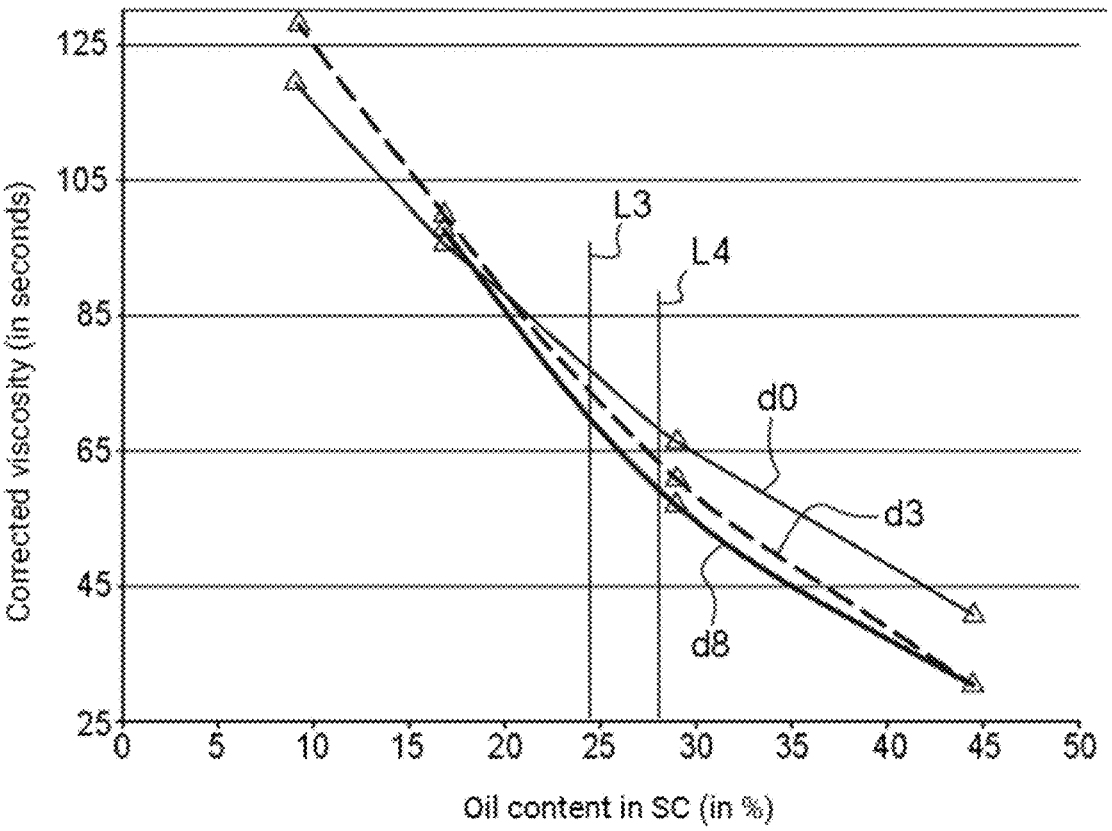

[Fig. 10]
| Gum juice | SC (in %) | Broad spectrum CBD temperature (in °C) | Robot temperature (in °C) | Homogenisation | Quality of the gum juice |
|---|---|---|---|---|---|
| S1 | 41 | | 30 | Normal | Normal |
| S2 | 43 | | 60 | Foam | Normal |
| S3 | 40 | 60 | 30 | Foam | Surface deposition |
| S4 | 41 | 60 | 60 | Foam | Normal |
| S5 | 43 | 60 | 60 | Foam | Normal |
| S6 | 43 | 20 | 20 | Normal | Particles |
| S7 | 42 | 60 | 30 | Normal | Particles |
| S8 | 41,5 | 70 | 70 | Foam | Normal |
| S9 | 41 | 40 | 60 | Foam | Particles |
| S10 | 41 | 40 | 40 | Foam | Particles |
[Fig. 11]
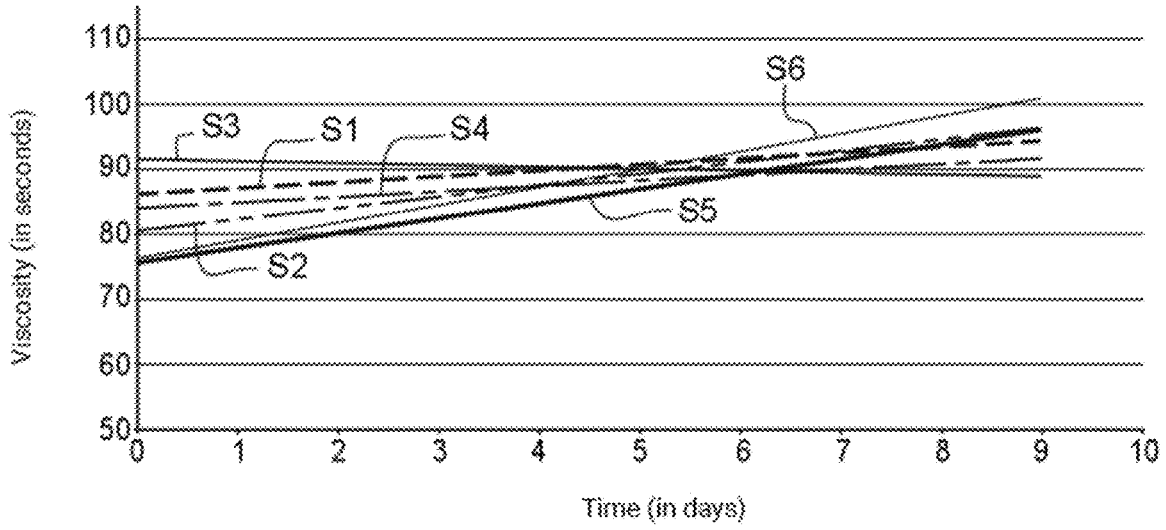
[Fig. 12]
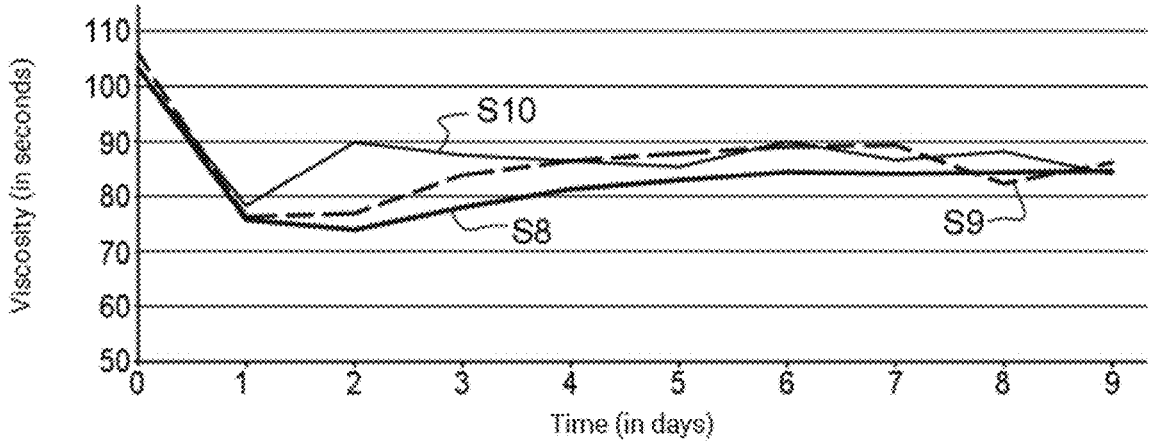

[Fig. 13]
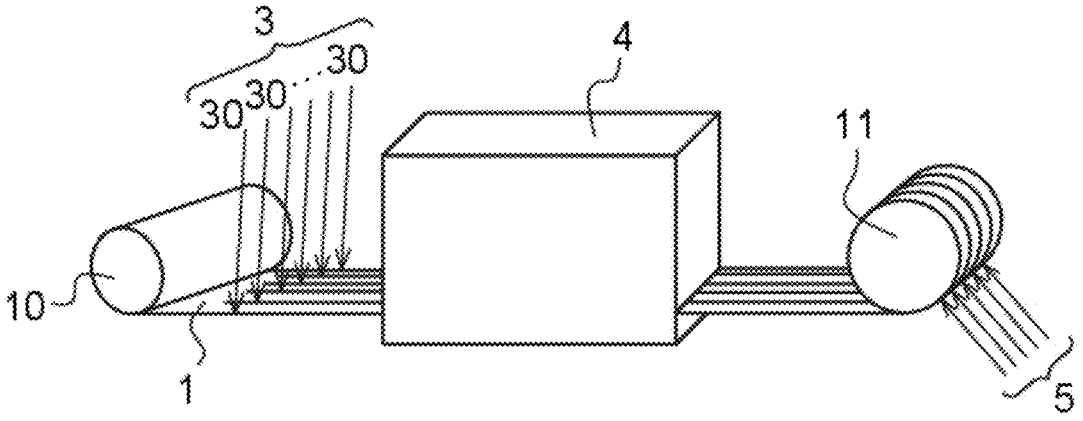
[Fig. 14]
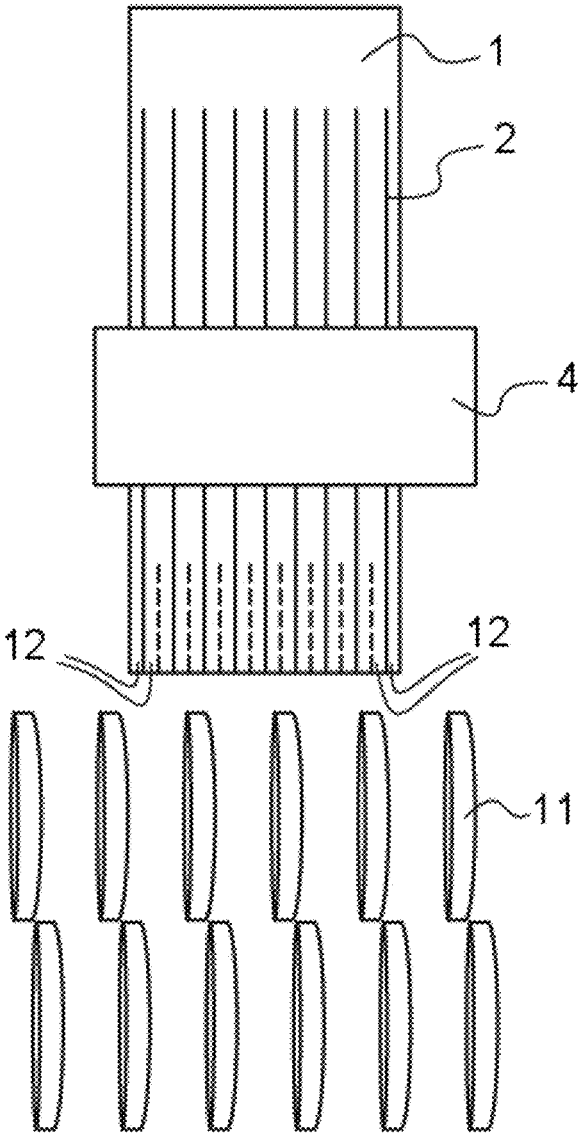

[Fig. 15]

| Juice | P1 | P2 | S11 | S12 | S13 | S14 | S15 | S16 | S17 | S18 | S19 | S20 |
|---|---|---|---|---|---|---|---|---|---|---|---|---|
| Raw material | Pure CBD | Pure CBD | Broad spectrum CBD | Broad spectrum CBD | Broad spectrum CBD | Broad spectrum CBD | Broad spectrum CBD | Broad spectrum CBD | Broad spectrum CBD | Broad spectrum CBD | Broad spectrum CBD | Broad spectrum CBD |
| Incorporation mode of CBD + oil | water | water | water | vessel | vessel | vessel | - | caramel + sorbitol | caramel + sorbitol | caramel + sorbitol | caramel + sorbitol | caramel + sorbitol |
| Temperature of CBD + oil (in °C) | 23 | 23 | 55 | 60 | 60 | 60 | - | 60 | 60 | 60 | 60 | 60 |
| Mix temperature (in °C) | 23 | 23 | 55 | 60 | 60 | 60 | 60 | 60 | 60 | 60 | 60 | 60 |
| CBD/oil ratio (in %) | 21/79 | 21/79 | 100/0 | 95/5 | 80/20 | 50/50 | 0 | 90/10 | 90/10 | 100/0 | 100/0 | 100/0 |
| Oil in dry formulation (in %) | 9.11% | 16.70% | 0.00% | 0.15% | 0.74% | 2.96% | 0.00% | 0.33% | 0.33% | 0.00% | 0.00% | 0.00% |
| Measured SC ($SC_{mes}$ in %) | 41.2% | 42.1% | 41.5% | 41.9% | 41.3% | 41.2% | 41.4% | 41.9% | 41.8% | 39.4% | 40.3% | 41.8% |
| Corrected viscosity* (in sec) | 81 | 81 | 77 | 80 | 85 | 75 | 98 | 78 | 76 | 121 | 84 | NC |
| *Correction value (SC%) | 41% | 42% | 40.5% | 40.5% | 40.5% | 40.5% | 40.5% | 40.5% | 40.5% | 40.5% | 40.5% | 40.5% |
| Presence of crystals in juice | No | No | No | Yes | Yes | Yes | No | No | No | No | No | No |
| Presence of candles/raised portions | No | No | Yes | Partial | No | No | No | No | No | No | No | Potential |
| Paper type | A | A | B | C | C | C | C | C | C | C | C | C |
| Paper porosity (in CU) | 1 | 1 | 50 | 10 | 10 | 10 | 10 | 10 | 10 | 10 | 10 | 10 |
| Papier basis weight ($g/m^2$) | 14 | 14 | 14 | 14 | 14 | 14 | 14 | 14 | 14 | 14 | 14 | 14 |

[Fig. 16]
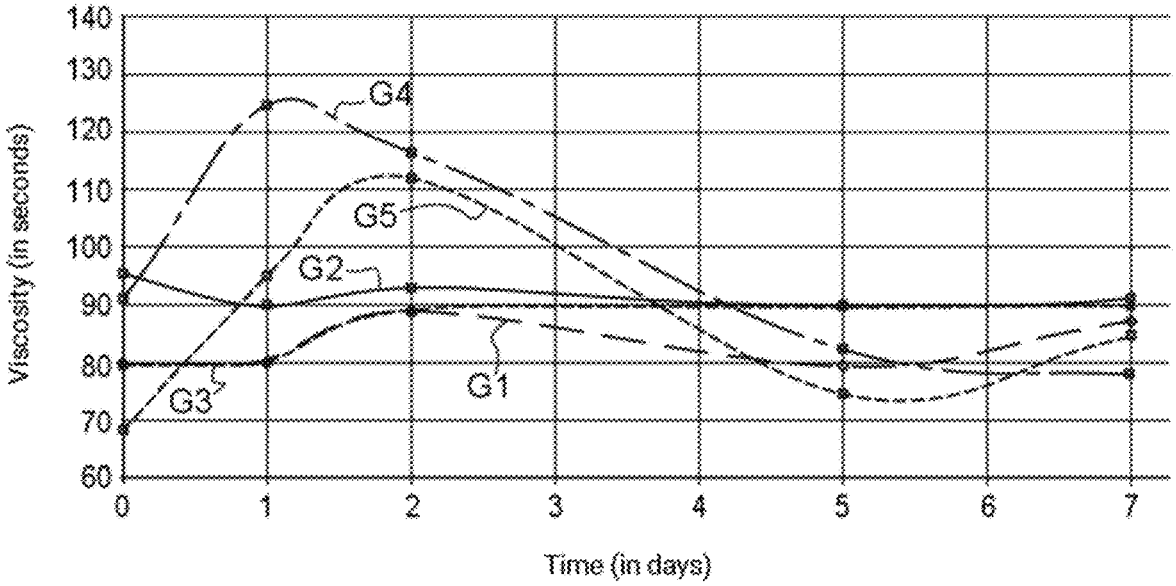

GUM FOR CIGARETTE PAPER, CIGARETTE PAPER AND PROCESS FOR MAKING IT

CROSS-REFERENCE TO RELATED APPLICATIONS

This application claims priority to French Patent Application No. 2011098, filed Oct. 29, 2020, the entire content of which is incorporated herein by reference in its entirety.

FIELD

The technical field of the invention is that of cigarette papers for rolling, and in particular the trickle of adhesive used to glue the cigarette paper by reactivation by licking, also known as the gum used to glue the cigarette paper, its manufacturing process and the cigarette paper obtained.

BACKGROUND

In order to improve the smoking experience, the introduction of recreational products in cigarettes has been developed. These recreational products are introduced into the paper itself. It has also been contemplated to introduce them into the trickle of gum of rolling papers.

However, these recreational products such as cannabinoids, and in particular cannabidiol or CBD, are soluble or miscible only in oil, but the rolling paper and gum are made from aqueous solutions. Water and oil are not miscible with each other, hence the difficulty of making these rolling papers enriched with cannabinoids.

On the other hand, the level of cannabinoids authorised for non-pharmaceutical uses is limited depending on the country, so it is important to be able to regulate the CBD content of a rolling sheet in a controlled and easy way.

To address these difficulties, it has been proposed to deposit the recreational product onto the paper with a binding agent, however the amount of deposited product is limited.

The paper was also infused with cannabinoids obtained from an oil extract of the *cannabis* plant. As *cannabis* extract containing cannabinoids is an oil that is not miscible with water, an emulsifier should be used to allow the cannabinoids to disperse uniformly in manufacturing the paper. These emulsions are additives that make the paper formulation more complex and less natural.

The introduction of cannabinoids into gum, although contemplated, has never been technically described.

All these solutions have the following drawbacks:

- cannabinoids or oil can cause stains to appear on the sheet of paper if the proportion of cannabinoids in the gum is too high,
- cannabinoids or oil can degrade adhesive properties of the gum,
- cannabinoids or oil modify physico-chemical properties as well as rheological properties of the gum, which can impact manufacture and implementation thereof,
- the stability over time of properties of the gum can vary according to the amount of cannabinoids or oil introduced,
- the amount of recreational product introduced is limited.

SUMMARY

The invention offers a solution to the problems previously discussed by allowing the introduction of cannabinoids into an adhesive solution. The cannabinoids used can, for example, be chosen pure or mixed among the following cannabinoids:

- Cannabidiol (CBD, 2-[(1R,6R)-6-Isopropenyl-3-methyl-3-cyclohexen-1-yl]-5-pentyl-1,3-benzenediol, C21H30O2, CAS number 13956-29-1),
- Cannabigerol (CBG, 2-[(2E)-3,7-Dimethyl-2,6-octadien-1-yl]-5-pentyl-1,3-benzenediol, C21H32O2, CAS number 25654-31-3),
- Cannabichromene (CBC, C21H30O2, 2-Methyl-2-(4-methyl-3-penten-1-yl)-7-pentyl-2H-chromen-5-ol, CAS number 20675-51-8),
- Cannabielsoin (EBC, C21H30O3, 6-Methyl-3-pentyl-9-(prop-1-en-2-yl)-5a,6,7,8,9,9a-hexahydrodibenzo[b,d] furan-1,6-diol, CAS number 52025-76-0)
- cannabinol (CBN, 6,6,9-trimethyl-3-pentyl-6H-benzo[c] chromen-1-ol, CAS number 521-35-7).

The adhesive solution can be made from natural plant compounds, more or less branched polyoses, plant exudates, extracts of seeds, fruits, cereals, possibly mixed together at measurable rates. They may be chosen from the following plant exudates:

- gum Arabic, with the monomeric constituents Galactose-Arabinose-Rhamnose-Glucuronic acid,
- ghatti gum, Arabinose-galactose-mannose-xylose-glucuronic acid,
- karaya gum, with the monomeric constituents rhamnose-galactose-galacturonic acid,
- fruit extracts, gum pectin, with the monomeric constituents galacturonic acid-rhamnose-galactose-arabinose-xylose,
- seed extracts; guar gum based on galactose and mannose, carob gum consisting of galactose-mannose,
- algae extracts, Agar, alginates and carrageenan;
- cereals and tubers, wheat, maize, sorghum or potato starches, with the monomeric constituent glucose.

A first aspect of the invention relates to a gum of vegetable origin, for rolling cigarette paper comprising a defined solids content, said gum is characterised in that it comprises a mixture of cannabinoids and edible oil, the edible oil being present in the mixture in a proportion p such that $0\% \leq p \leq 80\%$ by weight of the compound. Since cannabinoids are soluble only in oil and the gum is to be brought to the mouth because it should be reactivatable by licking once coated, smoked and swallowed, it is necessary to use a minimum of oil that should be edible. The gum can, for example, be gum arabic initially in solid form, put in solution mainly in water with the incorporation of various possible additives. This highly branched polysaccharide is edible and the mucilaginous solution obtained with a high solids content is used here for its adhesive properties, it is intended for the zone coating of rolling cigarette paper, the mucilaginous solution is ready for use.

Throughout the rest of the description, percentages given are percentages by weight of the related compounds in the ready-to-use formulation. The solids content (SC) corresponds to the material remaining when all the water has been removed from the preparation.

Beneficially, the maximum amount of edible oil in the gum is limited to 20% by weight of the gum solids content, in an embodiment less than 16% by weight of the gum solids content. With this proportion, the risks of oil phase separation in the gum over time are controlled.

According to a first embodiment, the cannabinoid is crystallised CBD and the edible oil is present in the mixture with a proportion p such that 20 s p 580%. This crystallised CBD is 99% pure, which makes it possible to optimise the amount of CBD introduced into the gum.

According to a second embodiment, an apolar crude *cannabis* extract—here referred to as broad-spectrum CBD—was used with or without oil and the edible oil was present in the mixture with a proportion p such that 0%≤p≤20% by weight of the compound. Broad-spectrum CBD can be derived from a supercritical CO2 crude *cannabis* extract and then partially refined. Broad-spectrum CBD requires less or no oil and is therefore easier to incorporate into the gum. Broad-spectrum CBD is in an embodiment free of THC (Tetrahydrocannabinol).

Beneficially, the edible oil is hemp oil. Hemp oil has the benefit that it contains few saturated fatty acids which are of a low fluidity and many polyunsaturated fatty acids which are very fluid, so it is naturally very fluid at 20° C., which is a definite benefit for dispersing the oil containing the cannabinoids in the gum juice. It is indeed important that the oil is not solid at room temperature.

Other oils can be selected from the following ones: all vegetable oils for food use, such as olive, rapeseed, grape seed, sunflower oil, which are relatively fluid or possibly palm, or coconut oil, which are more viscous depending on production needs and/or commercial availability.

Beneficially, the solids content comprises an exudate of plants, in an embodiment an exudate of acacia or gum arabic.

According to a first option, this acacia exudate is in an embodiment comprised of 70% to 30% of Senegal variety and 30% to 70% of Seyal. The composition of 70% Senegal and 30% Seyal gives the best results in terms of its machine processability and adhesiveness at a controlled cost. It is possible to limit costs by using up to 70% Seyal in gum arabic by depositing more gum on the paper, as the better quality Acacia Senegal is more expensive than Seyal.

According to a second option, gum arabic is comprised 100% Seyal. The cost is thus reduced.

According to a third option, gum arabic is comprised of 100% Senegal. This gives the best results.

A second aspect of the invention relates to a rolling cigarette paper containing gum with at least one of the above characteristics. The cigarette obtained by rolling the gummed cigarette paper allows the smoker to enjoy the aroma of *cannabis* both when licking the paper to activate adhesiveness as well as while smoking.

According to a first alternative, the gum is in the form of a trickle. The width of the trickle of gum can be between 3 mm and 15 mm, and in an embodiment between 5 mm and 10 mm. The amount of adhesive gum per reactivation deposited can vary between 30 and 60 mg/m over a width of 5 mm. It is thus possible to vary the amount of cannabinoid in the gummed paper.

According to a second alternative, the gum is in the form of a print. The gum is deposited by virtue of a printing process, so that it can be given any desired shape. The coating zone can be made by longitudinal or transverse, continuous or discontinuous trickles, or in the form of patterns distributed over more than 30% of the surface area of the cigarette paper sheet, which further increases the amount of cannabinoids on a same gummed paper.

A third aspect of the invention relates to a process for making a gum with at least one of the above characteristics, obtained from a gum juice and comprising the following steps of:

introducing a mixture of cannabinoids and edible oil, the edible oil being present in the mixture with a proportion p such that 0%≤p≤80% by weight, incorporating additives in water dissolving and putting in solution solids content in water.

Incorporation of the oil before or after incorporation of the gum arabic powder in water has little impact on the gum stability. However, stability appears to be slightly better when cannabinoids are incorporated before the gum powder. The dissolution of the solids as well as the oil introduction is done by stirring the mixture for about 30 minutes under vacuum in a reactor.

Beneficially, the broad-spectrum CBD with or without oil is heated up to 70° C. before introduction into the gum juice. The broad-spectrum CBD is heated up to 70° C. with or without oil before introduction into the reactor. Thus, the broad-spectrum CBD is more fluid and can be more easily incorporated into the gum juice.

Beneficially, the gum is stirred and heated to 70° C. until the cannabinoid is fully diluted for homogeneous incorporation. Heating the gum juice facilitates the incorporation of the cannabinoid-enriched mixture into the gum juice.

Beneficially, the gum juice has a dynamic viscosity at 22° C. of between 65 seconds and 115 seconds, and in an embodiment between 85 and 92 seconds. This dynamic viscosity is measured with an Afnor T30.014 viscosity cup; this cup is a flow cup used to determine the flow time of a volume of liquid through a calibrated orifice and is measured in seconds of flow. In the present invention, the cup has a diameter of 50 mm and a height of 44 mm with a hole of diameter 5.8 mm. The increase in oil content decreases the viscosity while the increase in solids content increases it, the balance between these two components makes it possible to obtain the desired viscosity for the given process.

Beneficially, gum juice contains between 37% and 45% solids content. This percentage makes it possible to obtain the desired viscosity. For crystalline CBD, the SC of the gum juice is desirably 41.0% and for broad spectrum CBD, the SC of the gum juice is desirably 40.7%.

Beneficially, the amount of exudate is higher than 75% by weight in the SC. This amount is desired to ensure proper paper adhesion.

Different aspects of the invention will be better understood upon reading the following description and examining the accompanying figures.

BRIEF DESCRIPTION OF THE FIGURES

The figures are set forth by way of indicating and in no way limiting purposes of the invention.

FIG. 1 is a view of a rolling cigarette paper,

FIG. 2 is a graph of the flow time of a liquid for a given volume under given conditions of temperature and pressure called the dynamic viscosity of a gum juice as a function of the amount of solids content (SC), FIG. 3 shows the variation of the dynamic viscosity of the gum juice over time as a function of the percent solids content in the presence of 9.11% oil, FIG. 4 shows the variation of the dynamic viscosity of the gum juice over time as a function of temperature with solids with a constant 9.11% oil portion in the solids, FIG. 5 illustrates the variation of the dynamic viscosity of gum juice as a function of the amount of solids and its variation over time, FIG. 6 shows the variation of the dynamic viscosity of the gum juice over time as a function of the percent solids content with constant oil proportion in the SC, FIG. 7 illustrates the variation of the dynamic viscosity of the gum juice over time as a function of different types of compounds dissolved in oil with 41% SC and 9.11% oil in SC, FIG. 8 illustrates the variation in the dynamic viscosity of the gum juice as a function of the amount of oil at a constant 43% solids content, FIG. 9 shows the stability of gum juice with a fixed SC and increasing oil content, FIG. 10 is a table showing the various modes of introducing the broad-spectrum CBD, FIG. 11 shows the variation in the dynamic viscosity of the gum juice over time as a function of the temperature at which the broad-spectrum CBD is introduced into the gum juice and the kneading temperature, FIG. 12 represents the dynamic viscosity of the oil as a function of the temperature of introducing the broad-spectrum CBD into the gum juice and the kneading temperature of the robot, FIG. 13 shows depositing the gum onto the paper and drying it in the oven, FIG. 14 is a top view of the oven and paper rolls, FIG. 15 is a table showing the results of gumming the paper according to different modes of introducing crystal CBD and broad-spectrum CBD into the adhesive preparation, FIG. 16 is a graph illustrating the variation in viscosity of different rubber mixtures.

DETAILED DESCRIPTION

Different tests have been carried out with CBD but the chemical structures of the different cannabinoids are relatively close to each other so that the physicochemical properties are also close to each other. All the cannabinoids are very apolar and therefore of a very low solubility in water. The behaviours of these cannabinoids are very close to those observed and measured for CBD.

The gum is first made in the form of a mucilaginous solution, here called a gum juice, which is deposited onto the rolling cigarette paper and then dried. Once dried, the gum should be soft enough not to crack and become sticky by wet reactivation of the saliva to make the cigarette. Rolling paper 1, illustrated in FIG. 1, shows a trickle of gum 2 deposited along the entire length of one of the edges of rolling paper 1.

The gum juice according to the invention is comprised of water, a humectant agent such as sorbitol, possibly caramel grade E150 (a), a branched polysaccharide such as gum arabic alone or in mixture with other natural vegetable gums, plant exudates, extracts of fruits, seeds or algae, cereals or tubers, a cannabinoid and possibly vegetable oil. The individual components are solubilised in water or suspended in water. Sorbitol keeps the gum elastic to prevent it from cracking after the gum juice has dried, and improves adhesion. Caramel or E150 is a colourant, used here to give contrast to the trickle of gum in relation to the sheet and to distinguish the location of the adhesive trickle. Gum arabic is, for proportions 30% from Senegal, a very powerful natural adhesive. The oil facilitates dispersion or incorporation of the cannabinoid in the gum juice.

The solids content is therefore comprised of all the solids contained in the gum juice.

The gum juice is deposited on the paper by the nozzle of a gumming machine in order to deposit a trickle of gum with a constant width onto the rolling paper. It is possible to choose this width between 5 and 15 mm, and it is also possible to deposit several trickles of gum. As the trickle is relatively narrow, the gum juice needs to have some viscosity to pass through the nozzle with a flow rate adapted for industrial production. It is also important that the gum juice becomes stable, so storage for at least 24 hours is desired and that it remains stable over time so that it can be stored for at least 72 hours before use. It is known that these preparations, made with polymers with more or less branched, networked long chains, are bulky and highly polydispersed, and they require 24 hours of reorganization before being produced and having a stable rheological behaviour on the machine. This phenomenon is potentially enhanced by the addition of CBD and oil.

Dynamic viscosity measurements of the gum juice have been carried out according to the percent solids content, the amount of oil and the variation overtime, with the objective of achieving a dynamic viscosity of between 80 s and 95 s at 22° C.

The chart in FIG. 2 has been made with a standard gum juice comprised of water, acacia powder consisting of 70% Senegal and 30% Seyal, sorbitol and caramel.

It can be seen from this chart that at the time to when the gum juice is made, the curve to representing the dynamic viscosity increases with the percent solids content (SC). The variation in viscosity has been measured over time at 24 hours ($t_{24}$), 48 hours ($t_{48}$), 72 hours ($t_{72}$) and 86 hours ($t_{86}$). A strong change in viscosity overtime is noticed between to and $t_{24}$. Thus, from 24 hours after the rubber has been made, the measurements slightly fluctuate. The viscosity has decreased (curve $t_{24}$) and continues to decrease at 48 h (curve $t_{48}$), then increases again at 72 h (curve $t_{72}$) and finally falls down again after 86 h (curve $t_{86}$). It can be seen on this chart that a 1% increase in solids content leads to a 15 s increase in dynamic viscosity. The dynamic viscosity target is set between 80 s and 95 s. The dynamic viscosity target is defined so that the gum juice can be run over a gumming machine and have a stable/defined amount of gum dry matter on the finished product (sheet of rolling paper).

The flow rate of juice delivered by the gumming machine is indexed to the paper running speed. The gum juice should be fluid enough to pass through the gumming machine's supply pipes but not so fluid that the paper is too wet, as moisture makes the paper brittle and can cause potential breakage during gumming (placing the gum onto the paper) and so that the gum is dry when leaving the drying oven. Indeed, as the paper is rewound on leaving the drying oven, if the gum is still wet upon leaving the gumming machine, the reel produced will be sticky and will not be able to be unwound for the following steps of manufacturing books.

FIG. 3 shows the variation in viscosity over time as a function of SC level with a stable 9.11% oil percentage. The time variation of viscosity as a function of percent solids content between 39% and 43% has been measured with an oil content set to 9.11% in order to establish a rule to be applied when increasing the percent solids content by 1%. The measurement has been made at 0, 3 and 9 days. The results at 0 days (curve $T_0$) are not homogeneous, but at 3 days (curve $T_3$) and 9 days (curve $T_9$), the curve is practically straight and allows us to deduce that, here too, a variation of 1% of solids content increases the viscosity by about 15 s between 39% and 43% SC.

FIG. 4 shows the variation of viscosity as a function of temperature from the measurement of two identical juices made by incorporating the oil before acacia powder A1 or after powder A2. It can be noticed that there is no significant difference, the drop in viscosity has an almost identical constant slope with an average A3. It can be deduced from this that a variation of +1° C. in temperature causes a variation of −2.5 s in dynamic viscosity and conversely a variation of −1° C. in temperature causes a variation of +2.5 s in dynamic viscosity.

FIG. 8 shows the variation over time of the viscosity of the gum juice as a function of the amount of oil with a constant percent solids content of 43% in order to evaluate its stability. These measurements were made in order to verify whether it was possible to significantly increase the oil content in the gum juice and thus the amount of solubilised CBD powder over 8 days. The proportion of oil in the gum varied between 9.11% and 44.44%:

curve H1 corresponds to an oil proportion of 9.11%,
curve H2 corresponds to an oil proportion of 16.7%,
curve H3 corresponds to an oil proportion of 28.62%,
curve H4 corresponds to an oil proportion of 44.5%, This it can be noticed that the juices are stable over 8 days after at least 24 hours. However, a phase separation has been observed in the 28% gum juice (H3) after 24 hours, so it was rehomogenised. The 44% juice (H4) was completely phase separated and of a very low adhesivity. Here, the oil percentage limit is therefore less than 28% of the solids content.

FIG. 9 illustrates the variation in viscosity as a function of the oil percent in the juice and its variation over time at 0 (d0), 3 (d3) and 8 days (d8). It is noticed that the viscosity decreases as the amount of oil increases, but from 25% oil (reference L3) the oil viscosity is no longer linear and from 28% oil (reference L4) the juice starts to phase separate. The oil proportion limit in the preparation is therefore 25%, and in an embodiment less than 20% of SC.

In FIG. 6, the variation over time of the dynamic viscosity measurements of juice with a constant 9.11% oil percent and a SC rate varying from 39 to 43%. By varying the percent solids content for a given 9.11% amount of oil, the variation of the kinetic viscosity over time is measured. The measurements have been carried out with the products ES1, ES2, ES3, ES4 and ES5 below. It is noticed that the gum juice of all these products is fairly stable over time after 24 hours and as expected, the dynamic viscosity increases with the percent solids content. The 41% percent SC has been selected because it has the desired viscosity.

Measurements with 40% to 43% solids content and 9.11% to 28.62% oil have been made, corrected and are visible in FIG. 5. The measurements have been made with the following compositions:

ES1: 43% solids content and 9.11% oil,
ES2: 42% solids content and 9.11% oil,
ES3: 41% solids content and 9.11% oil,
ES4: 40% solids content and 9.11% oil,
ES5: 39% solids content and 9.11% oil,
ES6: 43% solids content and 16.69% oil,
ES7: 43% solids content and 28.62% oil,
ES8: 41% solids content and 9.11% oil.

The measurements ES1, ES2, ES4, ES5 and ES8 have then been corrected for a simulation with 41% solids content. Therefore, the measurement ES1 has been corrected by subtracting 30 s, measurement ES2 by subtracting 15 s, measurement ES4 by adding 15 s, measurement ES5 by adding 30 s. The ES8 measurement has been calculated from viscosity measurements of two juices: one with 42% SC and the other with 39% SC, each corrected to 41% SC; each measuring point of these juices enables a curve with 41% SC to be made, therefore with a viscosity loss of 15 seconds relative to the results measured for the juice with an SC of 42% and a gain of 30 seconds for the juice with an SC of 39%. Finally, the measurement ES7 has been corrected by adding 30 seconds to the values thereby to target a 45% SC. This makes it possible to compare the variation over time of kinetic viscosity of the different concentrations of solids content. It is noticed that there is little dispersion, the dynamic kinetic viscosity remains between 80 s and 95 s.

The composition ES1, which has too high a viscosity, is not selected.

When increasing the amount of oil from 9.11% to 16.69%, the amount of solids content has to be increased in order to keep the same viscosity, its percentage thus switches to 43%. The measurement results correspond to the curve ES6. It is seen that the viscosity remains within the target range.

However, when the oil amount is 28.62% with a percent solids content of 43%, the curve ES7 drops too much, the viscosity is too low, since after 7 days it goes out of the minimum objective range and the gum juice gradually phase separates, i.e. water and oil separate into two phases. The amount of oil is therefore too high.

FIG. 7 illustrates the variation over time of six gum juices at extrapolated values of 41% SC and 9.11% oil, the results of these curves have been recalculated for a target SC of 41% SC and 9.11% oil, and then averaged. Three types of gum juice have been used in the tests:

J0: two with oil alone (one with SC=39% and one with SC=42%),
J1: two with oil and CBD powder (one with SC=39% and one with SC=42%) and,
J2: two with oil and menthol (one with SC=39% and one with SC=42%).

This figure allows the influence of CBD on the dynamic viscosity of the gum juice to be seen. Curve J0 corresponds to a gum juice with oil without CBD, curve J1 to a gum juice with oil with crystallised CBD and curve J2 to a gum juice with oil with menthol. Menthol was chosen for its similarity to CBD in terms of hydroxy and methyl groups, terpenes and the same carbon and oxygen number ratio in the compositional formula. It can be observed that there is a similarity between curves J0 and J1 from day 1. The introduction of crystallised CBD into the oil has only little influence on the dynamic viscosity of the gum. The CBD is dissolved in the oil by heating it and mixing the mixture under stirring until the crystals disappear.

Further tests have been carried out with oil-free, broad-spectrum CBD made from hemp extract containing approximately 85% CBD and other terpenes capable of imparting a particular odour and flavour. Oil-free broad-spectrum CBD can, for example, be obtained from super-critical CO2 extraction of hemp and then semi-purified. This oil-free broad-spectrum CBD is in solid form at room temperature and therefore needs to be heated to be introduced into the gum. It is at 60° C. that this broad-spectrum CBD becomes liquid. The objective is to find the best compromises in order to achieve a formulation that allows a satisfactory viscosity to be reached over 10 days.

The table in FIG. 10 shows the different processes used to introduce broad spectrum CBD:

S1 mixture without broad spectrum CBD without oil, with mixing made at 30° C. and the SC measurement was 41%,
S2 mixture without broad spectrum CBD without oil with mixing made at 60° C. and the SC measurement was 43%,
S3 mixture with broad spectrum CBD without oil, heated to 60° C. and introduced with mixing made at 30° C. and the SC measurement was 40%, S4 mixture with broad spectrum CBD without oil, heated to 60° C. and introduced with mixing made at 60° C. and the SC measurement was 41%, S5 mixture with broad spectrum CBD without oil, heated to 60° C. and introduced with mixing made at 60° C. and the SC measurement was 43%, S6 mixture with broad spectrum CBD without oil, not heated to 20° C. and introduced with a mixture not heated to 20° C. and the SC measurement was 43%, S7 mixture with broad spectrum CBD without oil, heated to 60° C. and introduced with mixing made at 30° C. and the SC measurement was 42%, S8 mixture with broad spectrum CBD without oil, heated to 70° C. and introduced with mixing made at 70° C. and the SC measurement was 41.5%, S9 mixture with broad spectrum CBD without oil, heated to 40° C. and introduced with mixing made at 60° C. and the SC measurement was 41%, S10 mixture with broad spectrum CBD without oil, heated to 40° C. and introduced with mixing made at 40° C. and the SC measurement was 41%.

These processes gave the following results:

S1 nothing in particular,

S2: the juice has foamed a lot.

S3: the juice has foamed a lot and a deposit on the surface on the 5th day appeared.

S4: The juice has foamed a lot and a pedicle appeared on the surface.

S5: The juice has foamed a lot and a pedicle appeared on the surface at 5 days.

S6: The oil-free broad spectrum CBD is very solid so a chip incorporation was made. After 30 minutes kneading, the oil-free broad spectrum CBD is still not incorporated. It has been stirred again by heating to 60° C., but after returning to room temperature, surface oil and oil spots are noticed in the mucilaginous preparation.

S7: The oil-free broad-spectrum CBD rapidly cooled and pellets were observed in the gum juice.

S8: The juice has foamed a lot and the mixture is homogeneous.

S9: The juice has foamed a lot and the oil-free broad-spectrum CBD at 40° C. does not liquefy in the mixture at 60° C.

S10: The juice has foamed a lot and the oil-free broad-spectrum CBD at 40° C. remains on the paddle of the mixer and the presence of lumps is noticed.

Viscosity results are visible in graphs 11 and 12. It can be noticed that the viscosities are fairly stable over 9 days, ranging from 66 to 105 s with an 88 seconds average and that there is a slight increase in viscosity over time.

It is noticed that the best results are obtained by preheating the oil-free broad-spectrum CBD to 60° C. prior to incorporation into the gum juice to introduce it at this temperature and mixing at 60° C.

The deposition of the gum juice onto the paper according to a continuous trickle process will now be described. However, other processes are possible, such as the flexographic process where the pre-dosing is carried out with an anilox with very particular engraving characteristics which are adapted to the wet amount to be conveyed on the paper. Anilox is used to supply a measured amount of ink or product to the flexographic plate. This preparation can be applied to a maximum of 30% of the sheet, plates, discrete patterns, designs, continuous or discontinuous lines.

As is visible in FIG. 13, paper 1 is arranged in rolls 10, unrolled and then nozzles 30 of a gumming machine 3 deposit the gum juice in a trickle 2 onto the paper, which is then put into an oven 4 where the gum juice is dried. Afterwards, paper 1 is cut by knives 5 into strips 12 in the centre of the trickle of gum 2 and then wound onto reels 11. Paper 1 will be then cut into rectangles to form sheets of rolling paper.

Gumming is carried out with the gumming machine 3 at a constant speed and at a constant oven 4 temperature. The amount conventionally expressed in dry gum equivalent deposited ranges from 36 mg per linear metre for 5 mm wide to 50 mg per linear metre for 5 mm wide. To increase the amount of gum deposited from 36 mg/m to 50 mg/m, the flow rate of nozzles 30 is increased and/or the gumming speed is reduced by some percent in relation to the speed at a lower deposition.

Gumming tests on paper have been carried out with a mixture of crystallised CBD and broad spectrum CBD.

The amount of CBD incorporated into the formulation and then deposited on the paper was less than or equal to 4.62% by weight of the SC in these tests. However, if 9% of oil containing 20% CBD is incorporated into the SC, the amount of CBD in the SC will be 1.8% by weight, with 16% oil containing 20% CBD in the SC, the amount of CBD in the SC will be 3.2% by weight, and with 25% oil containing 20% CBD in the SC, the CBD rate in the SC is 5% by weight. In an embodiment, according to national legislation, the cannabinoid will not contain THC.

A summary table setting forth manufacturing conditions of gums and results of gumming tests is set forth in FIG. 15. Nothing in particular has been noticed for the mixture with crystallised CBD solubilised in oil. However, in the case of broad-spectrum CBD, hard candles or hard filaments were formed between the paper at right angles with the coating member, this material then accumulated in stalagmites at the nozzle outlet when the solids content of the adhesive preparation is too high or when the temperature of the broad-spectrum CBD is below 60° C. in the gum juice production process. As such, the solids content of the gum juices is desirably 40.8% but should not exceed 41.7% if hemp oil is not used as an additive. Tests have been carried out in the presence and absence of hemp oil in gum juice. Indeed, the presence of oil allowed the phenomenon of candle formation to be reduced.

The measurement of juice S15, which is a conventional juice, does not contain CBD and it can be noticed that heating it upon manufacturing does not modify the qualities thereof.

Indeed, it can be seen in the table in FIG. 15 showing the results of tests on twelve juices P1, P2 and S11 to S20 that juice S11 made at less than 60° C. creates candles and that juices S12 and S20 also partly create some candles and their solids content measured is greater than 41.7%. It should be noted that the addition of 5% oil is not sufficient to make the candles (S12) disappear completely and crystals have also appeared.

Juices P1 and P2 were both made with CBD-enriched oil in a proportion of 22% CBD and 78% oil. For P1, there is 11.6% of the previous enriched oil with a measured SC of 41.20%, that is 2.5% CBD in the SC. For P2, there is 21.3% oil enriched with a measured SC of 41.20%, that is 4.6% CBD in the SC.

It can be seen that juices S16 and S17 with a percent solids content higher than 41.7% contain 10% oil, which allows gumming without the appearance of candles. Although juice S17 was homogenised prior to gumming and not S16, no difference has been noticed during gumming.

The appearance of crystals is also noticed in juices S13 and S14 respectively containing 20% and 50% oil in the CBD broad spectrum/oil mixture, that is a proportion of 0.74% and 2.96% of SC respectively. The presence of these crystals can be explained by an incorporation temperature of the broad-spectrum CBD into the gum at a temperature below 60° C. In order for the amount of gum deposited to be regular and homogeneous it is necessary that the juice be free of suspended matter, as this could damage the gum juice delivery pump, and clog the small diameter pipes present between the pump and the nozzles. It is therefore desirable to heat the broad-spectrum CBD to 60° C. prior to its incorporation into the juice manufacturing reactor in the presence of all additives. The amount of hemp oil in the SC is between 0% and 3% at 60° *C. minimum* for the incorporation of broad-spectrum CBD versus more than 9% of hemp oil at room temperature for the incorporation of crystallised CBD with in both cases the same residual amount of CBD in the gum (2.52% of the SC).

Broad-spectrum CBD is difficult to incorporate into gum juice, but it seems much more appropriate to mix broad-spectrum CBD with sorbitol and possibly caramel and oil additives beforehand. The three-dimensional structure of the gum is more capable of trapping broad-spectrum CBD. It appears that for a high percent SC, candles/raised portions appear, whereas for lower SC (i.e. for a lower amount of gum added as compared to the abundance of other additives, including broad spectrum CBD) these candles disappear. Infrared spectrometer analyses of these candles have shown that they are essentially comprised of CBD. Finally, it will also be possible to increase the amount of broad-spectrum CBD incorporated by also increasing the amount of oil in the SC from 3% to 20%. Conversely, it is also possible to decrease the amount of oil used to solubilise the crystallised CBD by heating the enriched oil as well as the double jacket gum juice preparation reactor.

The graph in FIG. 16 shows the results of tests carried out with different gum mixtures:

G1: mixture of broad spectrum CBD, 100% gum arabic, 40.6% measured SC, 40.5% calculated SC, at 70° C. and without caramel;

G2: mixture of hemp proteins without CBD with hemp proteins, 100% gum arabic, 40.7% measured SC, 40.5% calculated SC, at 23° C.;

G3: mixture of hemp proteins without CBD with hemp proteins, 100% gum arabic, 40.8% measured SC, 41% calculated SC, at 23° C.

G4: mixture without CBD, 98% gum arabic and 2% Karaya, 40.8% measured SC, 37.5% calculated SC, at 23° C.

G5: mixture without CBD, 80% gum arabic and 20% Cargill Icoat, 41% measured SC, 37.5% calculated SC, at 30° C.

Hemp proteins are in the form of fine particles that are insoluble in the mixture, are visible in the gum and serve to give it a particular appearance. The amount of hemp protein is desirably s 3% of the SC.

It can be noticed in FIG. 16 shows that at 7 days, the dynamic viscosity remains between 85 and 92 for all compositions G1 to G5.

It is noticed that at the incorporation levels of the compounds of the preparation as described in the present application, the gum adhesiveness is not impacted by the addition of cannabinoids.

The invention claimed is:

1. A process for making a gum juice comprising:

introducing a mixture of cannabinoid and edible oil in water, the edible oil being present in the mixture with a proportion p such that $0\% \leq p \leq 80\%$ by weight, incorporating other additives in said water, and dissolving and putting into solution dried extracts in said water to form the gum juice.

2. The process according to claim 1, wherein the cannabinoid is oil-free broad-spectrum cannabidiol (CBD) and wherein the cannabinoid is heated to 70° C. with or without oil before introduction in said water.

3. The process according to claim 1, wherein the gum juice is stirred and heated up to 70° C. until the cannabinoid is fully diluted in said water.

4. The process according to claim 1, wherein the gum juice has a dynamic viscosity at 22° C. of between 65 seconds and 115 seconds, the dynamic viscosity being measured with an Afnor T30.014 viscosity cup.

5. The process according to claim 4, wherein the gum juice comprises between 37% and 45% by weight of solids content.

6. The process according to claim 1, wherein the gum juice comprises an exudate of plants and an amount of exudate is greater than 75% by weight in the dried extracts.

7. A process for making a gum juice comprising:

introducing a cannabinoid in water, incorporating other additives in said water, and dissolving and putting into solution dried extracts in said water.

* * * * *